US008556044B2

(12) United States Patent
Marlow et al.

(10) Patent No.: US 8,556,044 B2
(45) Date of Patent: Oct. 15, 2013

(54) RAILWAY TRUCK MOUNTED BRAKE RIGGING HAVING RAISED CONNECTION OF FORCE-TRANSMITTING MEMBER WITH TRANSFER LEVER

(75) Inventors: Jonathon Marlow, Hobart, IN (US); Peter Gregar, Hobart, IN (US)

(73) Assignee: WABTEC Holding Corp., Wilmerding, PA (US)

( * ) Notice: Subject to any disclaimer, the term of this patent is extended or adjusted under 35 U.S.C. 154(b) by 314 days.

(21) Appl. No.: 12/901,763

(22) Filed: Oct. 11, 2010

(65) Prior Publication Data

US 2012/0085596 A1 Apr. 12, 2012

(51) Int. Cl.
*B61H 13/00* (2006.01)

(52) U.S. Cl.
USPC ..... 188/54; 188/33; 188/153 R; 105/157.1

(58) Field of Classification Search
None
See application file for complete search history.

(56) References Cited

U.S. PATENT DOCUMENTS 4,793,446 A * 12/1988 Hart et al. ..... 188/52
4,830,148 A * 5/1989 Hart et al. ..... 188/52
5,069,312 A 12/1991 Kanjo et al.
5,361,876 A * 11/1994 Haverick et al. ..... 188/52
5,400,874 A * 3/1995 Gayfer et al. ..... 188/52
5,667,040 A * 9/1997 Samulak et al. ..... 188/52
6,148,966 A * 11/2000 Daugherty et al. ..... 188/52
6,241,057 B1 * 6/2001 Hiatt ..... 188/219.1
6,279,689 B1 * 8/2001 Zemyan ..... 188/33
6,279,696 B1 * 8/2001 Daugherty et al. ..... 188/215
6,378,668 B1 * 4/2002 Zemyan et al. ..... 188/170
6,702,073 B2 * 3/2004 Sommerfeld ..... 188/219.1
6,971,488 B1 12/2005 Ring et al.
7,404,473 B2 * 7/2008 Engle ..... 188/107
7,931,130 B2 * 4/2011 Ring ..... 188/153 D
2007/0209886 A1 9/2007 Tuten
2008/0035432 A1 * 2/2008 Ring et al. ..... 188/52

* cited by examiner

*Primary Examiner* — Thomas Irvin
(74) *Attorney, Agent, or Firm* — James Ray & Assoc

(57) ABSTRACT

A railway vehicle truck mounted brake rigging includes spaced apart first and second brake beams, a horizontally disposed first transfer lever having a pivotal connection with one brake beam and further having an upturned flange, a link seated horizontally on the shoulder, a horizontally disposed second transfer lever having a pivotal connection with another brake beam, a first force-transmitting member passing through the first opening of the bolster for pivotal connection with each of the link and the second transfer lever, the pivotal connection is offset in a vertical direction from a horizontal plane defined by the first transfer lever, and a second force-transmitting member passing through the second opening of the bolster for pivotal connection with opposed ends of the respective first and second transfer levers.

10 Claims, 3 Drawing Sheets

RAILWAY TRUCK MOUNTED BRAKE RIGGING HAVING RAISED CONNECTION OF FORCE-TRANSMITTING MEMBER WITH TRANSFER LEVER

FIELD OF THE INVENTION

The present invention relates, in general, to a brake rigging for railway vehicles and, more particularly, this invention relates to a truck-mounted brake rigging in which pivotal connection of at least one force-transmitting member is offset in a vertical direction from a horizontal plane defined by transfer levers of such brake rigging.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

As is generally well known, railway vehicle truck mounted brake riggings employing a pair of spaced-apart beams, force-transmitting members and force transfer levers have been used extensively in the railway industry. However, there is a need to simply and economically accommodate truck bolsters of various configurations as well as to change the force ratios of such truck mounted brake riggings.

SUMMARY OF THE INVENTION

The invention provides a brake rigging for a railway vehicle truck having a longitudinal axis, a transverse axis perpendicular thereto, a pair of wheel/axle units parallel to the transverse axis, a bolster so disposed between the pair of wheel/axle units that its axis coincides with the transverse axis, the bolster having first and second openings spaced equidistantly on opposite sides of the longitudinal axis and passing through the bolster in a direction parallel thereto. The brake rigging includes a first and second brake beams interposed between the bolster and a respective one of the wheel/axle units so as to be in substantially parallel relationship with the bolster. The first and second brake beams having brake shoes carried thereon adjacent the wheel treads of the wheel/axle units for engagement therewith when the brake beams are spread apart. Each of the first and second brake beams defining each of a tension member, a compression member and a strut member rigidly connected to the tension and compression members at midpoints thereof. A first transfer lever is disposed in a generally horizontal plane when the brake rigging is installed into the railway vehicle truck. The first transfer lever has a pivotal connection at a point intermediate ends thereof with the strut member of one of the first and second brake beams. The first transfer lever defines first and second lever arms. A second transfer lever is also provided and has a pivotal connection at a point intermediate ends thereof with a strut member of another one of the first and second brake beams and defining first and second lever arms of the second transfer lever. There is a first force-transmitting member that passes through the first opening of the bolster and has a pivotal connection at one end thereof with a first lever arm of the second transfer lever. The first force-transmitting member includes a brake actuator operable in response to the supply of fluid pressure thereto for increasing the length of the first force transmitting member to accordingly increase spaced-apart distance between the first and second brake beams. There is also a second force-transmitting member that passes through the second opening of the bolster for pivotal connection with ends of respective second lever arms of the first and second transfer levers. There is also means for pivotally connecting the first transfer lever to an opposed end of the first force-transmitting member at an offset in a generally vertical direction from a generally horizontal plane defined by a surface of the first transfer lever. Such means includes a flange and a link, the flange is upstanding on one end of the first transfer lever and having an elongated tab defining a pair of shoulders and the link has an elongated slot receiving the elongated tab therethrough so that the link is seated on such flange and is offset in a vertical direction relative to a horizontal plane defined by the first transfer lever.

OBJECTS OF THE INVENTION

It is, therefore, one of the primary objects of the present invention to provide a truck mounted brake rigging for railway vehicles.

Another object of the present invention is to provide a truck mounted brake rigging for railway vehicles in which pivotal connection of at least one force-transmitting member is offset in a vertical direction from a horizontal plane defined by the transfer levers.

Yet another object of the present invention is to provide a truck mounted brake rigging for railway vehicles that employs horizontally disposed link attached by way of a slot and tab arrangement to a transfer lever and having a pivotal connection to a force-transmitting member, the link is offset in a vertical direction relative to a horizontal plane defined by the first transfer lever.

A further object of the present invention is to provide a truck mounted brake rigging for railway vehicles that allows simple and economical modification of the force ratios.

Yet a further object of the present invention is to provide a truck mounted brake rigging for railway vehicles that allows simple and economical adaptation to clearance provided in the truck bolster.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
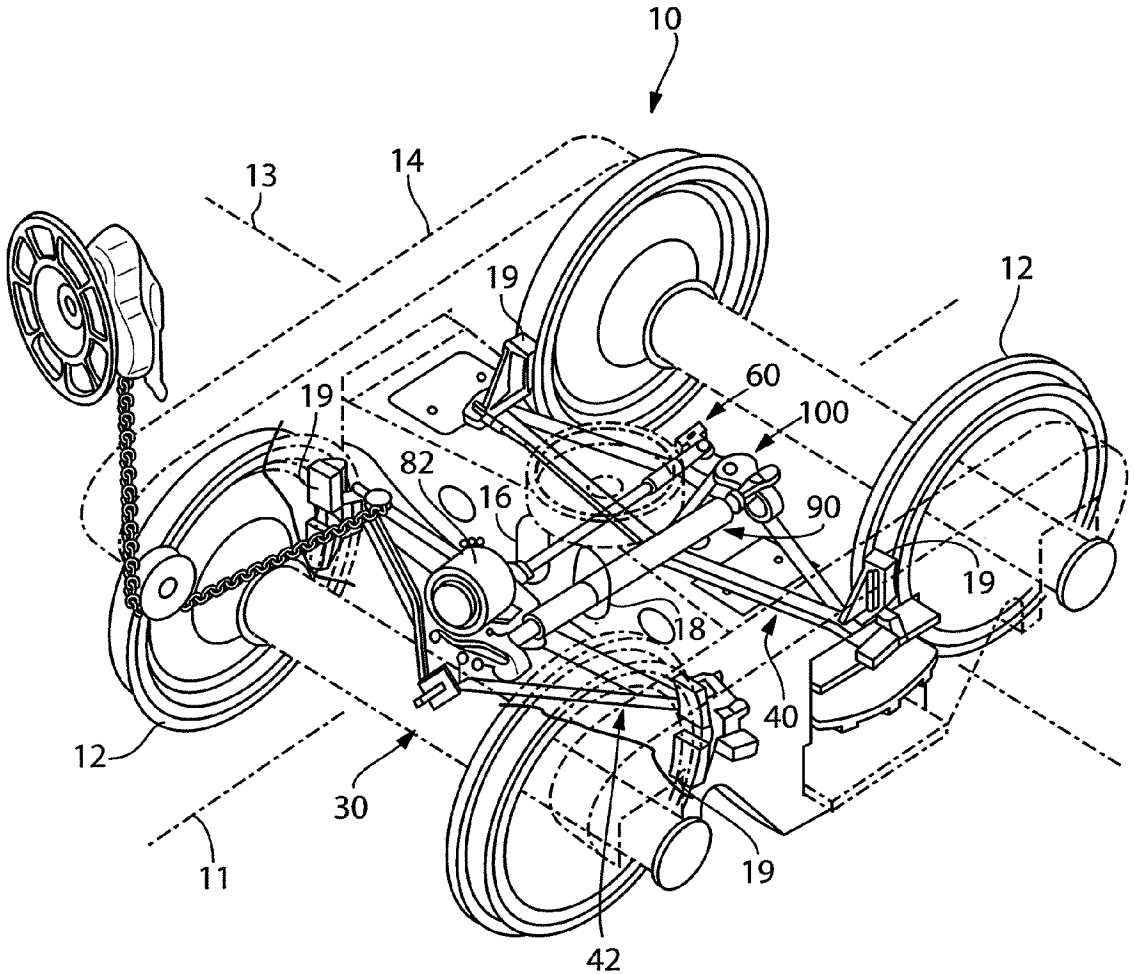
FIG. 1 is an isometric view of a brake rigging mounted on a railway vehicle truck.
Figure 2:
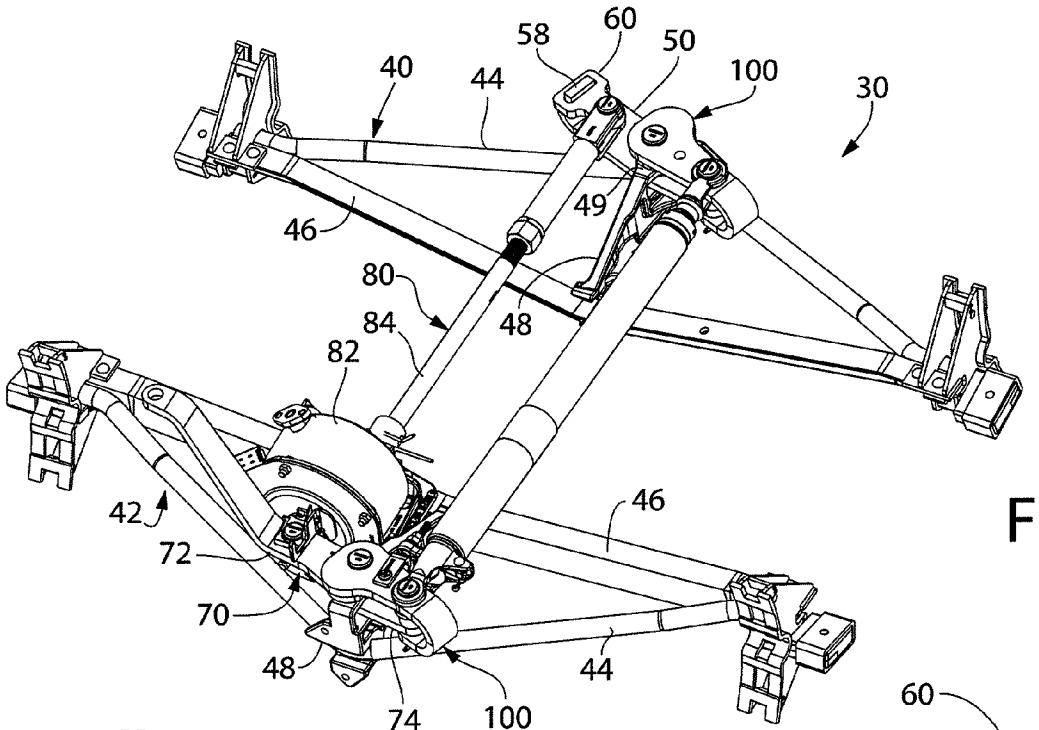
FIG. 2 is enlarged isometric view of the brake rigging of FIG. 1.
Figure 4:
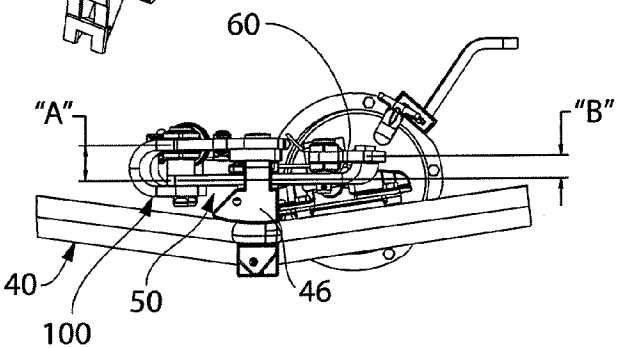
FIG. 4 is another elevation end view of the brake rigging of FIGS. 1-2.
Figure 3:
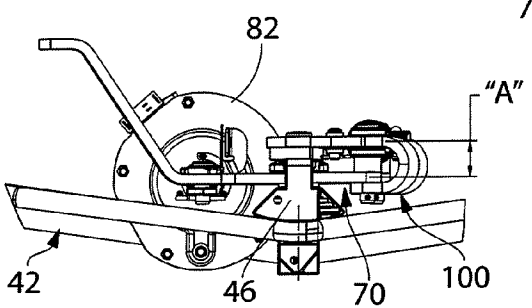
FIG. 3 is one elevation end view of the brake rigging of FIGS. 1-2.

Prior to proceeding to the more detailed description of the present invention, it should be noted that, for the sake of clarity and understanding, identical components which have identical functions have been identified with identical reference numerals throughout the several views illustrated in the drawing figures.

Now in reference to FIGS. 1-4, therein is shown a brake rigging, generally designated as 30, for a railway vehicle truck, generally designated as 10, having a longitudinal axis 11, a transverse axis 13 perpendicular thereto, a pair of wheel/axle units 12 parallel to the transverse axis 13, a bolster 14 so disposed between the pair of wheel/axle units 12 that its axis coincides with the transverse axis 13, the bolster 14 having first and second openings, 16 and 18 respectively, spaced equidistantly on opposite sides of the longitudinal axis 11 and passing through the bolster 14 in a direction parallel thereto.

The brake rigging 30 includes a first brake beam 40 and a second brake beam 42 interposed between the bolster 14 and a respective one of the wheel/axle units 12 so as to be in substantially parallel relationship with the bolster 14. The first and second brake beams, 40 and 42 respectively, having brake shoes 19 carried thereon adjacent the wheel treads of the wheel/axle units 12 for engagement therewith when the brake beams 40, 42 are spread apart. Each of the first and second brake beams, 40 and 42 respectively, defining each of a tension member 44, a compression member 46 and a strut member 48 rigidly connected to the tension and compression members, 44 and 46 respectively, at midpoints thereof.

Figure 6:
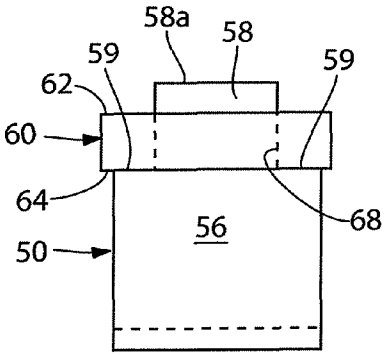
FIG. 6 is an elevation end view of the transfer lever and link arrangement of FIG. 5.
Figure 5:
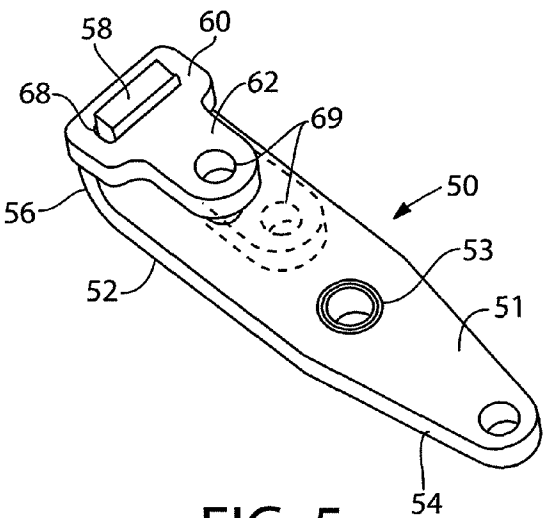
FIG. 5 is an isometric view of a transfer lever and link arrangement employed in the brake rigging of FIGS. 1-2.

A first transfer lever 50, best shown in FIGS. 5-6, is disposed in a generally horizontal plane when the brake rigging 30 is installed into the railway vehicle truck 10. The first transfer lever 50 has a pivotal connection, by way of an aperture 53 disposed at a point intermediate ends thereof, with the strut member 46 of one of the first and second brake beams, 40 and 42 respectively, best shown in FIG. 2 as a first brake beam 40. The first transfer lever 50 further defines first and second lever arms, 52 and 54 respectively, and having a flange 56 upstanding on an end of a first lever arm 52. The flange 56 has an elongated tab 58 disposed on a distal edge thereof, planar with the flange 56, and defining a pair of shoulders 59.

The brake rigging 30 also provides means for adapting to varying clearances provided in the bolster 14 and thus includes a link 60 having each of a substantially uniform thickness defined by a pair of spaced apart substantially planar surfaces 62, 64. The link 60 also has an elongate slot 66 formed through the thickness thereof adjacent to and spaced from one end. The elongated slot 66 is sized and shaped to operatively receive the elongated tab 58 therethrough so that a lower surface 64 of the link 60 is rested on the pair of shoulders 59 and is offset in a spaced apart and generally parallel relationship with an upper surface 51 of the first transfer lever 50 and so that the link 60 is generally aligned with the transverse axis of the truck 10. The combination of the elongated tab 58 and the elongated slot 68 substantially eliminates rotation of the link 60 in a horizontal plane relative to the transfer lever 50. There is also at least one aperture 69 formed through the thickness of the link 60 adjacent to and spaced from an opposed end thereof. The at least one aperture 69 is disposed in the generally horizontal plane at a predetermined distance along the transverse axis 13 from the pivotal connection of the first transfer lever 50 with the strut member 46 of the first brake beam 40. It is also contemplated that a free edge 58*a* of the elongated tab 58 may extend outwardly past the upper surface 62 of the link 60 so as to mitigate vibration of the brake rigging 30 during motion of the truck 30 and enhancing adaptability of the brake rigging 30 as it will be explained further in this document.

The combination of the first transfer lever 50 and the link 60 affords compliance with bolsters 14 having varying clearances provided by the openings 16 and 18 while eliminating the undesirable force moment onto the brake shoes 19 as the transfer levers 50 and 70 are disposed in a horizontal plane central to the brake shoes 19.

Although the link 60 is shown in various figures as extending inwardly in a direction toward the pivotal connection of the first lever arm 50 with the strut member 46, such link 60 may be positioned to extend outwardly in a direction away from such pivotal connection, wherein the link 60 is simply rotated one hundred and eighty (180) degrees. Equally as well, the link 60 may be disposed in a downward direction by simply installing the first transfer lever 50 in an up-side-down manner relative to showing of FIG. 5.

Furthermore, although the first transfer lever 50 and the link 60 are shown and described as separate members, it is contemplated to make them integral with each other for applications affording such configuration, particularly, when the link portion includes more than one aperture 69.

A second transfer lever 70 is provided and has a pivotal connection at a point intermediate ends thereof, generally identical to the pivotal connection of the first transfer lever 50, with a strut member 46 of the second brake beam 42 and defines first and second lever arms 72 and 74 respectively of the second transfer lever 70.

There is also a first force-transmitting member 80 passing through the first opening 16 of the bolster 14 for pivotal connection with each of the link 60 and a respective first lever arm 72 of the second transfer lever 70. The first force-transmitting member 80 includes a brake actuator 82 operable in response to the supply of fluid pressure thereto for increasing the length of the first force transmitting member 80 to accordingly increase spaced-apart distance between the first and second brake beams, 40 and 42 respectively. The first force-transmitting member 80 further includes rod 84 having one end adapted for pivotal connection with the link 60 at the aperture 69 and having an opposed end thereof attached to the brake actuator 82. The brake actuator 82 includes a pivotal connection to the first lever arm 72 of the second transfer lever 70, wherein the pivotal connection of the brake actuator 82 is offset in a generally vertical direction from a pivotal connection of the rod 84 with the link 50.

The final essential element of the brake rigging 30 is a second force-transmitting member 90 passing through the second opening 18 of the bolster 14 for pivotal connections with ends of respective second lever arms 54, 74 of the first and second transfer levers, 50 and 70 respectively. Such second force-transmitting member 90 may be a conventional slack adjuster device taught in the U.S. Pat. No. 4,662,485 assigned to the assignee of the claimed invention.

Figure 8:
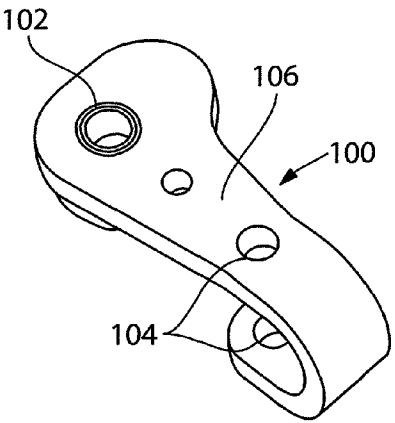
FIG. 8 is an isometric view of a J-shaped link employed in the brake rigging of FIGS. 1-2.

The pivotal connection of the second force-transmitting member 90 with the second lever arm 54 of the first transfer lever 50 may be provided in a conventional manner. However, it is also contemplated that such pivotal connection may be offset in the vertical direction above the upper surface 51 of either one or both transfer levers with an employment of a J-shaped link 100, best shown in FIG. 8, disposed in the generally horizontal plane and having a first aperture 102 disposed adjacent to and spaced from one end thereof for pivotal connection to the upraised portion 49 of the strut member 48 and a second aperture 104 disposed adjacent to and spaced from the opposed end thereof for pivotal attachment to one end of the second force-transmitting member 90 and the second lever arms 54, 74 of the first and second transfer levers 50 and 70 respectively, all with conventional pins. The height of the J-shaped link 100 may be selected so that the upper surface 62 of the link 60 is offset in the vertical direction from an upper surface 106 of the J-shaped link 100, wherein both upper surfaces 62, 106 are offset in such vertical direction from the upper surface 51 of the first transfer lever 50. By way of an example only in FIG. 4, such brake rigging 30 is illustrated wherein the offset "A" of the J-shaped link 100 is greater than the offset "B" of the link 60.

By way of further example in FIGS. 1-4, the brake rigging 30 includes first and second J-shaped links 100, each pivotally connecting one end of the second force-transmitting member 90 to a respective first or second transfer lever, 50 and 70 accordingly.

Figure 7:
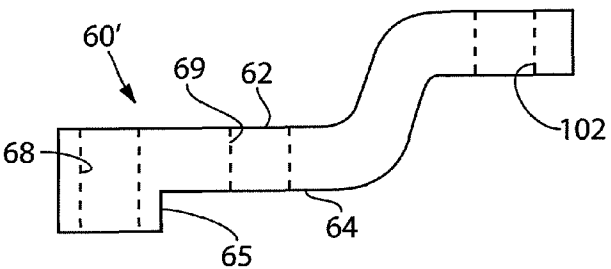
FIG. 7 is an elevation side view of the transfer lever and link arrangement of FIG. 5.

It would be understood that the link 60, referenced as 60' in FIG. 7', may be also adapted with provisions including aperture 102 for pivotal attachment to the upraised portion 49 of the strut member 48 in absence or in addition to the J-shaped link 100, as best shown in FIG. 7. It is also contemplated that the link 60 or 60' may be adapted with an abutment 65 disposed on the lower surface 64 in alignment with the elongated slot 69, which is then extended through such abutment 69, so that the offset "A" can be varied for a specific application of the brake rigging 30, taking further advantage of the protruding nature of the elongated tab 58 and subsequently providing for standardization and installation cost economy of the brake rigging 30.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. A brake rigging in combination with a railway vehicle truck having a longitudinal axis, a transverse axis perpendicular thereto, a pair of wheel/axle units parallel to said transverse axis, a bolster so disposed between said pair of wheel/axle units that its axis coincides with said transverse axis, said bolster having first and second openings spaced equidistantly on opposite sides of said longitudinal axis and passing through said bolster in a direction parallel thereto, said brake rigging comprising:

(a) first and second brake beams interposed between said bolster and a respective one of said wheel/axle units so as to be in substantially parallel relationship with said bolster, said first and second brake beams having brake shoes carried thereon adjacent said wheel treads of said wheel/axle units for engagement therewith when said brake beams are spread apart, each of said first and second brake beams defining each of a tension member, a compression member, and a strut member rigidly connected to said tension and compression members at midpoints thereof;

(b) a first transfer lever disposed in a generally horizontal plane when said brake rigging is installed into said railway vehicle truck, said first transfer lever having a pivotal connection at a point intermediate the ends thereof with said strut member of one of said first and second brake beams, said first transfer lever defining first and second lever arms;

(c) a second transfer lever having a pivotal connection at a point intermediate the ends thereof with a strut member of another one of said first and second brake beams and defining first and second lever arms of said second transfer lever;

(d) a first force-transmitting member passing through said first opening of said bolster and having a pivotal connection at one end thereof with a first lever arm of said second transfer lever, said first force-transmitting member including a brake actuator operable in response to the supply of fluid pressure thereto for increasing the length of said first force transmitting member to accordingly increase spaced-apart distance between said first and second brake beams;

(e) a second force-transmitting member passing through said second opening of said bolster for pivotal connection with ends of respective second lever arms of said first and second transfer levers; and (f) means for pivotally connecting said first transfer lever to an opposed end of said first force-transmitting member in a spaced apart relationship in a generally vertical direction from a generally horizontal plane defined by a surface of said first transfer lever, said means for pivotally connecting said first transfer lever to said opposed end of said first force-transmitting member including each of a flange and a link, said flange upstanding on an end of a first lever arm and having an elongated tab disposed on a distal edge of said flange and defining a pair of shoulders, said link having each of a substantially uniform thickness defined by a pair of spaced apart substantially planar surfaces, an elongated slot formed through said thickness of said link adjacent to and spaced from one end thereof, said elongated slot sized and shaped to operatively receive said elongated tab therethrough so that a lower surface of said link is rested on said pair of shoulders at said offset to an upper surface of said first transfer lever and so that said link is generally aligned with said transverse axis of said truck, and at least one aperture formed through said thickness of said link adjacent to and spaced from an opposed end thereof, said at least one aperture disposed at a distance from said pivotal connection of said first transfer lever with said strut member of said first brake beam.

2. The brake rigging, according to claim 1, wherein said opposed end of said force-transmitting member is located between one end of said first transfer lever and said pivotal connection thereof.

3. The brake rigging, according to claim 1, wherein said means for pivotally connecting said first transfer lever to said opposed end of said first force-transmitting member further includes a separation between said surface of said first transfer lever and a surface of said opposed end of said first force-transmitting member.

4. A brake rigging in combination with a railway vehicle truck having a longitudinal axis, a transverse axis perpendicular thereto, a pair of wheel/axle units parallel to said transverse axis, a bolster so disposed between said pair of wheel/axle units that its axis coincides with said transverse axis, said bolster having first and second openings spaced equidistantly on opposite sides of said longitudinal axis and passing through said bolster in a direction parallel thereto, said brake rigging comprising:

(a) first and second brake beams interposed between said bolster and a respective one of said wheel/axle units so as to be in substantially parallel relationship with said bolster, said first and second brake beams having brake shoes carried thereon adjacent said wheel treads of said wheel/axle units for engagement therewith when said brake beams are spread apart, each of said first and second brake beams defining each of a tension member, a compression member, and a strut member rigidly connected to said tension and compression members at midpoints thereof;

(b) a first transfer lever disposed in a generally horizontal plane when said brake rigging is installed into said railway vehicle truck, said first transfer lever having a pivotal connection at a point intermediate the ends thereof with said strut member of one of said first and second brake beams, said first transfer lever defining first and second lever arms and having a flange upstanding on an end of a first lever arm, said flange having an elongated tab disposed on a distal edge thereof and defining a pair of shoulders;

(c) a link having each of a substantially uniform thickness defined by a pair of spaced apart substantially planar surfaces, an elongated slot formed through said thickness of said link adjacent to and spaced from one end thereof, said elongated slot sized and shaped to operatively receive said elongated tab therethrough so that a lower surface of said link is rested on said pair of shoulders and is offset in a generally vertical direction relative to an upper surface of said first transfer lever and so that said link is generally aligned with said transverse axis of said truck, and at least one aperture formed through said thickness of said link adjacent to and spaced from an opposed end thereof, said at least one aperture disposed in said generally horizontal plane at a predetermined distance from said pivotal connection of said first transfer lever with said strut member of said first brake beam;

(d) a second transfer lever having a pivotal connection at a point intermediate the ends thereof with a strut member of another one of said first and second brake beams and defining first and second lever arms of said second transfer lever;

(e) a first force-transmitting member passing through said first opening of said bolster for pivotal connection with each of said link and a respective first lever arm of said second transfer lever, said first force-transmitting member including a brake actuator operable in response to the supply of fluid pressure thereto for increasing the length of said first force transmitting member to accordingly increase spaced-apart distance between said first and second brake beams; and (f) a second force-transmitting member passing through said second opening of said bolster for pivotal connection with ends of respective second lever arms of said first and second transfer levers.

5. The brake rigging, according to claim 4, wherein said brake actuator includes a pivotal connection with said first lever arm of said second transfer lever, wherein said pivotal connection of said brake actuator is offset in said generally vertical direction from a pivotal connection of said first force-transmitting member to said link.

6. The brake rigging, according to claim 4, wherein said link further includes a second aperture for pivotal connection of said link to an upraised portion of said strut member of said first brake beam.

7. The brake rigging, according to claim 4, wherein a free edge of said elongated tab extends outwardly past the upper surface of said link.

8. The brake rigging of claim 4, further including an abutment disposed on said lower surface of said link in alignment with said elongated slot which is then extended through said abutment.

9. The brake rigging of claim 4, further including first and second J-shaped links disposed in said generally horizontal plane, each of said first and second J-shaped links having a first aperture disposed adjacent to and spaced from one end thereof and a second aperture disposed adjacent to and spaced from the opposed end thereof.

10. The brake rigging, according to claim 9, wherein an upper surface of said link is offset in said vertical direction from an upper surface of at least one of said first and second J-shaped links.

* * * * *